United States Patent [19]

Goppelt et al.

[11] Patent Number: 4,782,799

[45] Date of Patent: Nov. 8, 1988

[54] SELF-ADJUSTING HYDRAULIC VALVE TAPPET

[75] Inventors: Dieter Goppelt, Aurachtal; Dieter Schmidt, Nurnberg; Steffen Hertrich, Herzogenaurach; Jürgen Rabe, Aurachtal, all of Fed. Rep. of Germany

[73] Assignee: INA Walzlager Schaeffler KG, Fed. Rep. of Germany

[21] Appl. No.: 84,627

[22] Filed: Aug. 11, 1987

[30] Foreign Application Priority Data

Aug. 22, 1986 [DE] Fed. Rep. of Germany ..... 3628619

[51] Int. Cl.[4] ..... F01L 1/24

[52] U.S. Cl. ..... 123/90.55; 123/90.56

[58] Field of Search ..... 123/90.55, 90.56

[56] References Cited

U.S. PATENT DOCUMENTS

| | | | |
|---|---|---|---|
| 4,392,462 | 7/1983 | Lesher | 123/90.55 |
| 4,579,094 | 4/1986 | Döppling et al. | 123/90.55 |
| 4,632,075 | 12/1986 | Camosso et al. | 123/90.55 |
| 4,635,593 | 1/1987 | Kodama | 123/90.55 |
| 4,648,360 | 3/1987 | Schaeffler | 123/90.55 |
| 4,686,947 | 8/1987 | Speil | 123/90.55 |
| 4,688,525 | 8/1987 | Nakamura | 123/90.55 |
| 4,688,526 | 8/1987 | Buente et al. | 123/90.55 |

FOREIGN PATENT DOCUMENTS

| | | | |
|---|---|---|---|
| 3409235 | 9/1985 | Fed. Rep. of Germany | 123/90.55 |
| 3437478 | 4/1986 | Fed. Rep. of Germany | 123/90.55 |
| 3528348 | 2/1987 | Fed. Rep. of Germany | 123/90.55 |
| 2093940 | 9/1982 | United Kingdom | 123/90.55 |

*Primary Examiner*—E. Rollins Cross

*Attorney, Agent, or Firm*—Bierman & Muserlian

[57] ABSTRACT

A self-adjusting hydraulic valve tappet arranged in a guide bore of a cylinder head of an internal combustion engine and being contacted at one end face of the valve tappet by a cam and bearing with a second end face against the end of a valve stem, the tappet comprising a cup-shaped housing comprised of a hollow cylindrical wall closed at one end by an end member against the outside of which the cam abuts and a cylindrical guide sleeve concentric with the cylindrical wall and surrounded by an external oil reservoir and in which the play compensating element is guided for longitudinal movement and abuts at its end against the valve stem characterized in that the valve tappet is comprised of three main structural elements of (a) the outer metallic cup-shaped housing (1)

(b) a polymeric inner element (4,31,32) accommodated therein defining the guide sleeve and forming the external oil reservoir (17) together with the cup-shaped housing (1) and (c) the self-adjusting play compensating element (7) guided for longitudinal movement in the guide sleeve.

14 Claims, 4 Drawing Sheets

SELF-ADJUSTING HYDRAULIC VALVE TAPPET

STATE OF THE ART

Figure 1:
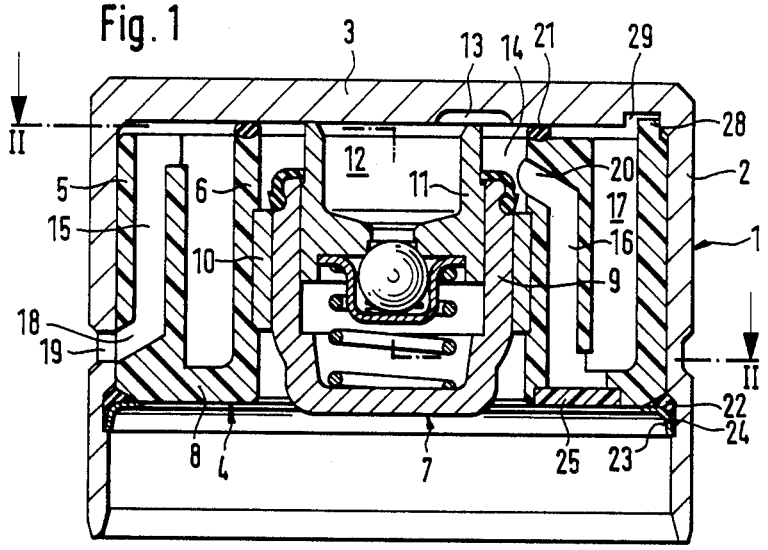

Self-adjusting hydraulic valve tappets arranged in a guide bore of a cylinder head of an internal combustion engine and being contacted at one end face of the valve tappet by a cam and bearing with a second end face against the end of a valve stem, the tappet comprising a cup-shaped housing comprised of a hollow cylindrical wall closed at one end by an end member against the outside of which the cam abuts and a cylindrical guide sleeve concentric with the cylindrical wall and surrounded by an external oil reservoir and abutting at its end against the valve stem are known. In the known tappets, the housing and the elements connected therewith to confine the external oil reservoir for defining the guide sleeve, and possibly additional elements for attaining a determined oil guidance are made of metal and suitably connected with each other e.g. through welding. The number of components and of the joints leads to a very complicated valve tappet when its production is concerned, and there is frequently the danger of leakages or fractures at the joints (SE EP-OS No. 00 30 781 and DE-OS No. 34 09 236).

OBJECTS OF THE INVENTION

It is an object of the invention to provide a self-adjusting hydraulic valve tappet with a relatively small number of components and in which especially complicated connecting methods like e.g. welding are essentially avoided.

This and other objects and advantages of the invention will become obvious from the following detailed description.

THE INVENTION

The self-adjusting hydraulic valve tappet of the invention arranged in a guide bore of a cylinder head of an internal combustion engine and being contacted at one end face of the valve tappet by a cam and bearing with a second end face against the end of a valve stem, the tappet comprising a cup-shaped housing comprised of a hollow cylindrical wall closed at one end by an end member against the outside of which the cam abuts and a cylindrical guide sleeve concentric with the cylindrical wall and surrounded by an external oil reservoir and in which the play compensating element is guided for longitudinal movement and abuts at its end against the valve stem characterized in that the valve tappet is comprised of three main structural elements of (a) the outer metallic cup-shaped housing (1)

(b) a polymeric inner element (4,31,32) accommodated therein defining the guide sleeve and forming the external oil reservoir (17) together with the cup-shaped housing (1) and (c) the self-adjusting play compensating element (7) guided for longitudinal movement in the guide sleeve.

The structural elements (a) and (c) correspond completely to those of conventional tappets but all other components are combined as a polymeric inner element resulting in the advantage that greater freedom in the construction design is obtained during production, e.g. by injection molding of this inner element and connections, especially weld joints, can be avoided.

Such polymeric inner elements can be designed, for example, as consisting of two concentric cylindrical walls, one of which extends tightly against the bore wall of the hollow cylindrical wall of the housing while the other one defines the guide sleeve for the self-adjusting valve compensation element and both are connected to each other at least at their ends facing away from the end face of the housing by a radial flange in fluid-tight manner, and at the facing surfaces of both cylindrical walls are provided axially extending tube like channels at a respective circumferential area, of which the channel arranged at the radially outer cylindrical wall communicates freely at its end adjaent to the end face of the housing with the external oil reservoir and extends at its opposite end into a radial opening which is in alignment with a radial oil supply port in the hollow cylindrical wall of the housing while the channel arranged at the guide sleeve extends at its end adjacent to the bottom of the housing into a radial opening leading to the interior of the guide sleeve, and communicates at its opposite end with the external oil reservoir. This relatively simple element which can be produced e.g. through injection molding, is only then inserted within the metallic housing. However, respective seals are required to seal the cylindrical wall which defines the guide sleeve at its end facing the end face of the housing against the metallic housing and to seal the radial outer wall at its end facing away from the end face of the housing against the metallic housing.

The sealing between the cylindrical wall defining the guide sleeve and the bottom of the housing may be omitted when both cylindrical walls are also connected to each other by a radial flange in fluid-tight manner at their ends facing the end face of the housing.

Especially suitable is the production of the inner element so that one element of it which includes both cylindrical walls, the radial flange facing the end face of the housing and both channels, is directly shaped into the metallic housing during its production by injection-molding while the other radial flange is subsequently attached thereto e.g. through welding.

In any event, a relative rotation between the housing and the inner element must be avoided to maintain the alignment of the radial oil inlet port in the hollow cylindrical wall with a corresponding opening in the inner element. This is attained by providing the inner element with an axial projection which engages in a recess in the inner surface of the end face of the housing. In the previously described embodiment in which as components of the inner element are directly injected into the metallic housing, there is the possibility of providing at least one radial bore(s) in the hollow cylindrical wall which is penetrated by polymeric material during the injection procedure so as to affect a safeguard against rotation.

According to a modification of the invention, the polymeric inner element includes two components, each of which comprises two concentric cylindrical walls which are connected at their ends by a respective radial flange, wherein the two components are nested into one another so that two respectively corresponding walls of both components abut each other in fluid-tight manner under prestress wherein in at least one of the contacting surfaces of the cylindrical walls respective recesses are provided for forming the channels and the recesses may have a helical shape. In this case, it has proven especially suitable to produce the one component, which defines the guide sleeve and thus is mechanically stressed to a considerable degree, of a relatively hard polymeric material optionally with reinforcing fibers, while the other component which provides the sealing against the metallic housing is made of an elastomeric or an elastomeric-like material.

To permanently keep both the individual components of the inner element together in axial direction, the two components snap into each other in a form-fitting manner by means of radially overlapping sections. In all embodiments, it is also possible to provide the entire inner element with a radial projection snapping in a form-fitting manner into a respective recess of the hollow cylindrical wall of the metallic housing. In some instances, it may be suitable to provide a metallic retaining ring for an additional safeguard against axial displacement of the inner element which retaining ring is inserted in a circumferential groove of the hollow cylindrical wall of the metallic housing and abuts the inner element. Depending upon the embodiment, it may be suitable to insert a metallic guide bush into the guide sleeve of the inner elements made of polymeric material to prevent undesired high wear.

Figure 2:
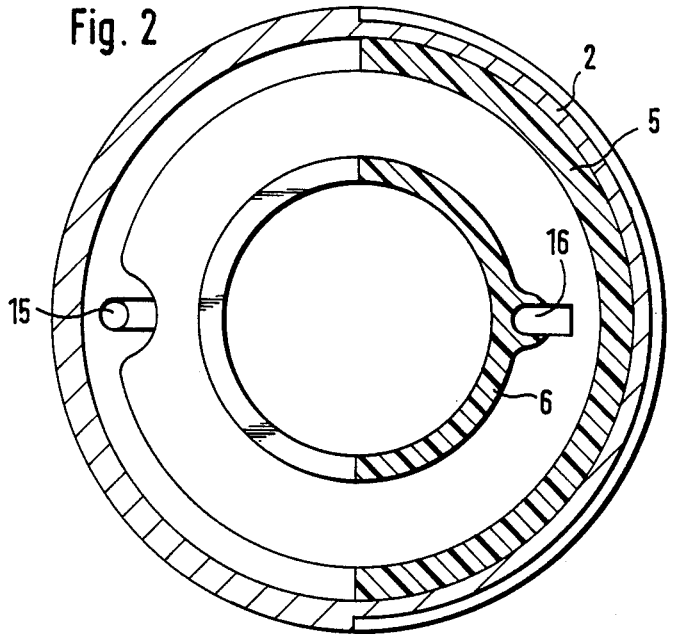
Figure 3:
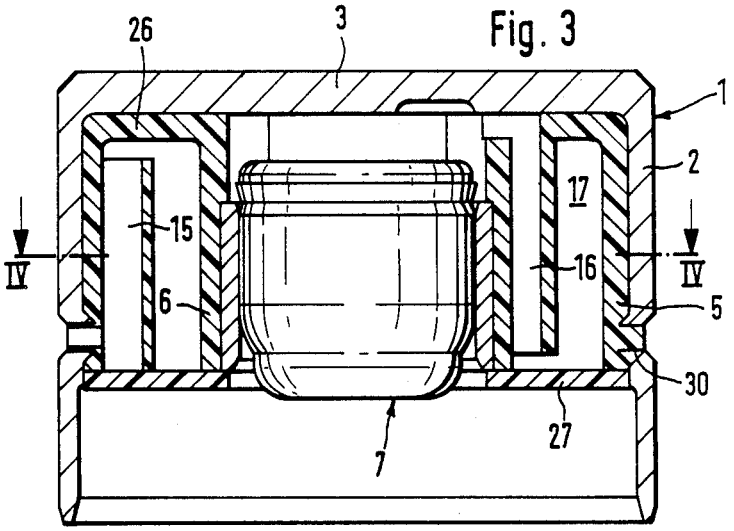
Figure 4:
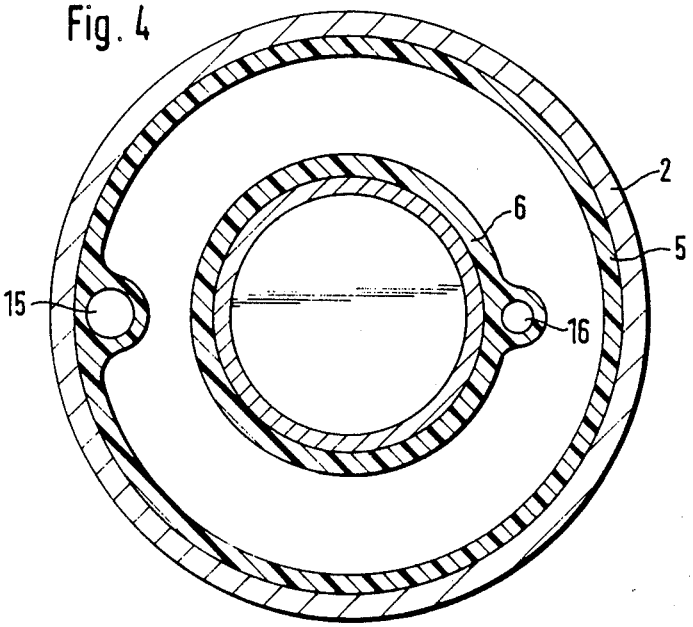
Figure 5:
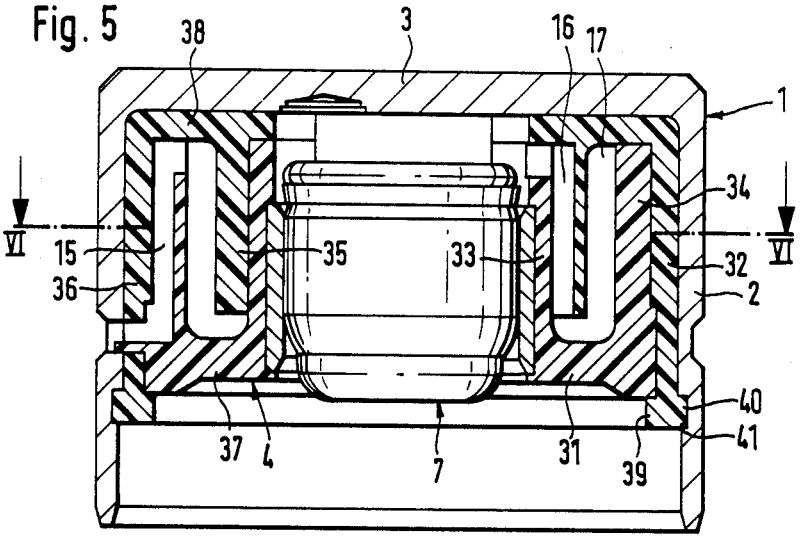
Figure 6:
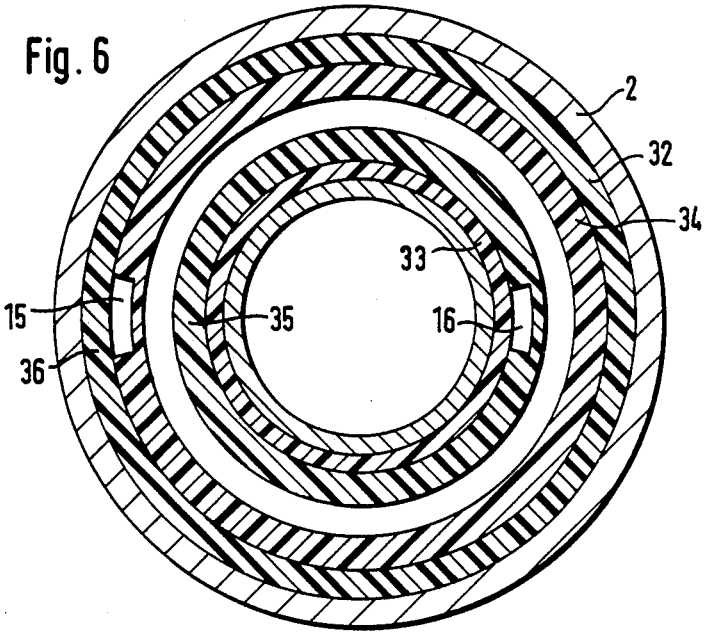

Referring now to the drawings:

FIGS. 1,3,5 and 7 are longitudinal cross-sections through different embodiments of the valve tappet of the invention and FIGS. 2,4 and 6 are cross-sections in accordance with the cutting lines indicated in the respective previous FIGS. 1,3 and 5, respectively.

The tappet illustrated in FIG. 1 has a cup-shaped housing (1) which includes a hollow cylindrical wall (2) with integral end face (3). Accommodated within this housing (1) is the polymeric inner element (4) consisting of two cylindrical walls (5 and 6) concentrically arranged to each other with the wall (5) abutting the hollow cylindrical wall (2) while the wall (6) defines the guide sleeve for the self-adjusting hydraulic compensation element (7). Both walls (5 and 6) are connected at their end facing away from the end face (3) of the housing (1) by radial flange (8) in a fluid-tight manner. The hydraulic clearance compensation element (7) includes the outer piston (9) which is guided in the metallic guide bush (10) accommodated in form-fitting manner in the cylindrical wall (6) and which, on the other hand, slidingly receives the inner piston (11) with narrow play. At its end facing the end face, the inner piston (11) has a central oil reservoir (12) which is in communication via recess (13) in the inner surface of the bottom (3) with an annular space (14) which is defined by the inner piston (11), on the one hand, and by the cylindrical wall (6), on the other hand.

At the facing surfaces of the two cylindrical walls (5 and 6), axially extending tube-like channels (15 and 16) are provided at a respective circumferential area with channel (15) arranged at the cylindrical wall (5) and communicating freely at its end adjacent to the end face with the external oil reservoir (17) while extending at its opposite end into a radial opening (18) which is in alignment with a radial oil supply port (19) in the hollow cylindrical wall (2), and with channel (16) arranged at the wall (6) and extending at its end adjacent to the end face of the housing into a radial opening (20) which leads to the annular space (14), and communicating at its opposite end with the external oil reservoir (17).

At its end facing the end face, the wall (6) is sealed by a seal (21) against the metallic housing and at its end facing away from the end face (3), the wall (5) is sealed by a gasket (22) against the wall (2). Gasket (22) is prestressed by the metallic retaining ring (23) which is inserted into the circumferential groove (24) of the hollow cylindrical wall (2). In the area at which the elongated channel (16) is shaped at the inner element (4), the radial flange (8) is provided with an opening for allowing insertion of a shaping tool and which is subsequently closed by an inserted plate (25).

For ease of illustration, the self-adjusting hydraulic compensation element (7) has been omitted in FIG. 2 as well as in the following FIGS. 4 and 6. For the same reason, the clearance compensation element (7) is illustrated in FIG. 3 and 5 in only an elevational view.

The embodiment of FIGS. 3 and 4 differs from that of FIG. 1 in several points. In contrast to the embodiment of FIG. 1, an additional radial flange (26) is provided which connects in a fluidtight manner both cylindrical walls (5 and 6) also at their end facing the end face (3) of the housing (1). By this means, the additional arrangement of the seal (21) may be omitted. Moreover, the structural element comprising the cylindrical walls (5 and 6), the radial flange (26) and the channels (15 and 16) was produced so that it was formed by injection molding directly into the metallic housing (1) and the further radial flange is provided as circular plate (27) which is subsequently attached and connected e.g. through ultrasonic sealing with the other element.

The embodiment of FIGS. 1 and 2 includes a safety means to prevent relative motion between the housing (1) and the inner element and is provided by engaging a projection (28) of the inner element (4) in a recess (29) of the end face (3). In the embodiment of FIG. 3, the safety means to prevent relative rotation is obtained so that during injection of material for formation of the inner element (4) in the housing (1), this material engages at at least one circumferential point(s) in radial bores (30) of the wall (2).

In the embodiment of FIGS. 5 and 6, the polymeric inner element (4) comprises two components (31 and 32), each of which consists of two concentric walls (33,34 and 35,36) which are connected at their ends by a respective radial flange (37,38). Both components (31 and 32) are nested into one another so that two respectively corresponding walls (32,34 and 33,35) of both components abut each other in fluid-tight manner under prestress. To form the channels (15 and 16), respective recesses are provided in the cylindrical walls (32 and 33). Finally, as shown in FIG. 7, the channels (15 and 16) may also be formed in a helical shape.

Figure 7:
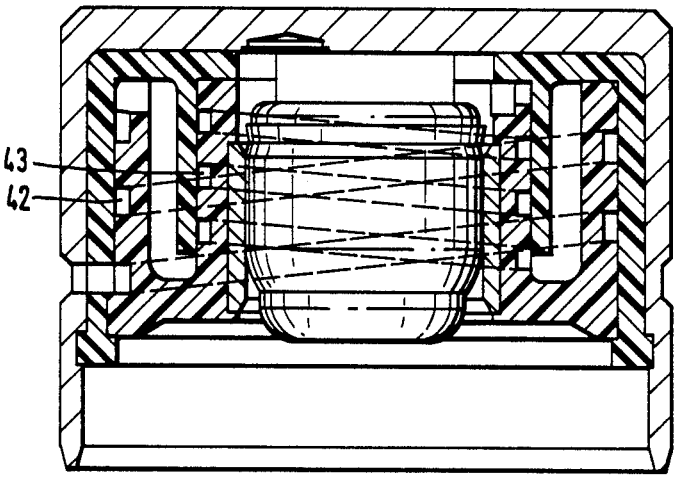

In the embodiments of FIGS. 5 to 7, both elements defining the inner element (4) snap into each other in form-fitting manner for providing a mutual protection against axial displacement. For that purpose, at its free end, the wall (32) overlaps in its bore the inner element with a projection (39). Simultaneously, the wall (32) includes at its outer surface a projection (40) which snaps into a recess (41) in the wall (2).

Various modifications of the valve tappet of the invention may be made without departing from the spirit or scope thereof and it should be understood that the invention is intended to be limited only as defined in the appended claims.

What we claim is:

1. A self-adjusting hydraulic valve tappet arranged in a guide bore of a cylinder head of an internal combustion engine and being contacted at one end face of the valve tappet by a cam and bearing with a second end face against the end of a valve stem, the tappet comprising a cup-shaped housing comprised of a hollow cylindrical wall closed at one end by an end member against the outside of which the cam and a cylindrical guide sleeve concentric with the cylindrical wall and surrounded by an external oil reservoir and in which the play compensating element is guided for longitudinal movement and abuts at its end against the valve stem, characterized in that a polymeric inner element (4,31,32) defining the guide sleeve and forming the external oil reservoir (17) together with the cupshaped housing (1) comprises two concentric cylindrical walls (5,6), one of which abuts tightly against the bore wall of the hollow cylindrical wall (2) of the housing (1) and the second defines the guide sleeve for the self-adjusting play compensating element (7) and which are connected to each other by a radial flange (8,27) in a fluid-tight manner at least at their ends facing away from the end face (3) of the housing (1) and axially extending tube like channels (15,16) at the facing surfaces of the two cylindrical walls (5,6) at a respective circumferential area with the channel (15) arranged at the radially outer cylindrical wall (5) communicating freely at its end adjacent to the end face (3) of the housing with the external oil reservoir (17) and extending at its opposite end into a radial opening (18) aligned with a radial oil supply port (19) in the hollow cylindrical wall (2) of the housing (1) and channel (16) arranged at the guide sleeve extends at its end adjacent to end face (3) of the housing (1) into a radial opening (20) leading to the interior of the guide sleeve and communicating at its opposite end with the external oil reservoir (17).

2. A valve tappet of claim 1 wherein respective seals (21,22) are provided to seal the cylindrical wall (6) defining the guide sleeve at its end facing the end face (3) of the housing (1) and the radial outer wall (5) at its end facing away from the end face (3) of the housing (1) against the metallic housing (1).

3. A valve tappet of claim 1 wherein the two cylindrical walls (5,6) are also connected to each other at their ends facing the end face (3) of the housing (1) by a radial flange (26) in a fluid-tight manner.

4. A valve tappet of claim 1 wherein a part of the polymeric inner element (4) and including both cylindrical walls (5,6), the radial flange (26) facing the end face (3) of the housing (1) and both channels (15,16), is directly shaped into the metallic housing (1) during its production by injection-molding, while the other radial flange (27) is subsequently attached thereto.

5. A valve tappet of claim 4 wherein radial flange (27) is attached by welding.

6. A valve tappet of claim 1 wherein the inner element (4) has an axial projection (28) engaging in a recess (29) in the inner surface of the end face (3) of the housing (1).

7. A valve tappet of claim 4 wherein the polymeric material engages in at least one radial bore (30) of the hollow cylindrical wall (2) of the housing (1).

8. A valve tappet of claim 1 wherein the polymeric inner element is comprised of two elements (31,32), each of which comprises two concentric cylindrical walls (33,34 and 35,36) which are connected to each other by a respective radial flange (37,38) at their one ends, the two elements nesting into one another so that two respectively corresponding walls (33,35 and 34,36) of both elements (31,32) abut each other in fluid-tight manner under prestress wherein at least one of the contacting surfaces of the cylindrical walls (33,35 and 34,36) is provided with respective recesses (15,16) for forming the channels (15,16).

9. A valve tappet of claim 7 wherein the recesses (42,43) are defined as a helical shape.

10. A valve tappet of claim 7 wherein the one element (31) which defines the guide sleeve is made of a relatively hard polymeric material optionally with reinforcing fibers, while the other element (32) which provides the sealing against the metallic housing (1) is made of an elastomeric or an elastomeric-like material.

11. A valve tappet of claim 7 wherein both elements (31,32) snap into each other in a form-fitting manner by radially overlapping sections (39).

12. A valve tappet of claim 1 wherein the inner element has a radial projection (40) which snaps in form-fitting manner into a respective recess (41) of the hollow cylindrical wall (2) of the metallic housing (1).

13. A valve tappet of claim 1 wherein the inner element is secured against axial displacement by a metallic retaining ring (23) which is inserted in a circumferential groove (24) of the hollow cylindrical wall (2) of the metallic housing (1) and abuts the inner element (4).

14. A valve tappet of claim 1 wherein a metallic guide bush (10) is inserted in the guide sleeve of the inner element (4).

* * * * *